US010726722B2

(12) United States Patent
Maeda

(10) Patent No.: US 10,726,722 B2
(45) **Date of Patent: *Jul. 28, 2020**

(54) DRIVING SUPPORT DEVICE AND DRIVING SUPPORT METHOD

(71) Applicant: Mitsubishi Electric Corporation, Tokyo (JP)

(72) Inventor: Takashi Maeda, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/880,949

(22) Filed: Jan. 26, 2018

(65) Prior Publication Data

US 2018/0165958 A1 Jun. 14, 2018

Related U.S. Application Data

(63) Continuation of application No. 14/910,720, filed as application No. PCT/JP2013/081031 on Nov. 18, 2013, now Pat. No. 10,102,746.

(51) Int. Cl.
*G08G 1/0967* (2006.01)

(52) U.S. Cl.
CPC . *G08G 1/096783* (2013.01); *G08G 1/096716* (2013.01); *G08G 1/096741* (2013.01)

(58) Field of Classification Search
CPC ..... G08G 1/096783; G08G 1/096716; G08G 1/096741
See application file for complete search history.

(56) References Cited

U.S. PATENT DOCUMENTS 6,396,417 B2 5/2002 Lee
2005/0165547 A1 7/2005 Uotani
2007/0078598 A1 4/2007 Watanabe et al.
(Continued)

FOREIGN PATENT DOCUMENTS

JP 07-029094 A 1/1995
JP 2001-118194 A 4/2001
(Continued)

OTHER PUBLICATIONS

Communication dated Apr. 4, 2017 issued by the Japanese Patent Office in counterpart Application No. 2015-547365.
(Continued)

*Primary Examiner* — James J Yang
(74) *Attorney, Agent, or Firm* — Sughrue Mion, PLLC; Richard C. Turner

(57) ABSTRACT

A driving support device includes: an intersection information acquiring unit 3 to obtain signal light information about traffic signals installed at one or more intersections ahead of a road along which the vehicle is traveling and to obtain distances to the intersections; a vehicle state detector 4 to detect a position and speed of travel of the vehicle; a signal passableness deciding unit 5 to decide a passable or impassable state of the traffic signals by the vehicle from the signal light information, the distances to the intersections, and the position and speed of travel of the vehicle; and a display controller 7 to display the passable or impassable state of the traffic signals decided by the signal passableness deciding unit 5 by changes of color on the map.

10 Claims, 10 Drawing Sheets

(56) References Cited

U.S. PATENT DOCUMENTS

| | | | | |
|---|---|---|---|---|
| 2010/0007523 | A1* | 1/2010 | Hatav | G01C 21/26 340/901 |
| 2010/0063722 | A1 | 3/2010 | Yoshikawa | |
| 2011/0040621 | A1* | 2/2011 | Ginsberg | G01C 21/3492 705/14.49 |
| 2013/0110316 | A1 | 5/2013 | Ogawa | |
| 2013/0110371 | A1* | 5/2013 | Ogawa | G08G 1/095 701/70 |
| 2013/0322665 | A1* | 12/2013 | Bennett | G08G 1/096855 381/300 |

FOREIGN PATENT DOCUMENTS

| | | | |
|---|---|---|---|
| JP | 2004-069418 | A | 3/2004 |
| JP | 2007-72783 | A | 3/2007 |
| JP | 2007-170864 | A | 7/2007 |
| JP | 2010-066059 | A | 3/2010 |
| JP | 2010-169624 | A | 8/2010 |
| JP | 2011-070652 | A | 4/2011 |
| JP | 2012-133624 | A | 7/2012 |
| JP | 2013-045304 | A | 3/2013 |

OTHER PUBLICATIONS

International Search Report for PCT/JP2013/081031 dated Feb. 10, 2014.

Communication dated Sep. 6, 2016, from the Japanese Patent Office in counterpart Japanese application No. 2015-547365.

* cited by examiner

DRIVING SUPPORT DEVICE AND DRIVING SUPPORT METHOD

CROSS REFERENCE TO RELATED APPLICATIONS

This application is a Continuation of U.S. application Ser. No. 14/910,720, filed Feb. 8, 2016, which is a national stage entry of International Application No. PCT/JP2013-081031, filed Nov. 18, 2013, the contents of which are incorporated herein by reference in their entireties.

TECHNICAL FIELD

The present invention relates to a driving support device and a driving support method that give information about a passable or impassable state of a traffic signal by a vehicle.

BACKGROUND ART

For example, Patent Document 1 discloses an apparatus for providing a driver with information about a recommended speed suitable for the road along which a vehicle travels. When the apparatus decides from the signal light information about traffic signals installed at one or more intersections ahead of the road along which the vehicle travels, from distances from the vehicle to the intersections and from a vehicle state of the vehicle that there is a speed at which the traffic signals at the intersections are passable during the green light, it provides the driver with the information about the speed as a recommended speed.

CITATION LIST

Patent Document

Patent Document 1: Japanese Patent Laid-Open No. 2012-133624.

SUMMARY OF THE INVENTION

Problems to be Solved by the Invention

The conventional technique typified by the Patent Document 1 provides a driver with the information only about the recommended speed at which the vehicle can pass through the signals. Accordingly, when there are two or more intersections ahead of the vehicle, it is difficult for the driver to recognize the most distant passable intersection signal at the recommended speed, and this offers a problem of preventing an appropriate driving support.

The present invention is implemented to solve the foregoing problem. Therefore it is an object of the present invention to provide a driving support device and a driving support method enabling a driver to readily recognize the passable traffic signals at the intersections by the vehicle.

Means for Solving the Problem

A driving support device in accordance with the present invention is a driving support device that supports driving of a vehicle and comprises: an intersection information acquirer to obtain signal light information about traffic signals installed at one or more intersections ahead of a road along which the vehicle is traveling and to obtain distances to the intersections; a vehicle state detector to detect a position and speed of travel of the vehicle; a signal passableness decider to decide a passable or impassable state of the traffic signals by the vehicle from the signal light information and the distances to the intersections the intersection information acquirer obtains, and from the position and speed of travel of the vehicle the vehicle state detector detects; and a display controller to display a map including the position of the vehicle on a display, and to display the passable or impassable state of the traffic signals decided by the signal passableness decider by changes of color on the map.

Effect of the Invention

According to the present invention, it offers an advantageous effect of enabling the driver to readily recognize the intersections with the passable traffic signals by the vehicle.

MODES FOR CARRYING OUT THE INVENTION

The best mode for carrying out the invention will now be described with reference to the accompanying drawings to explain the present invention in more detail.

Embodiment 1

Figure 1:
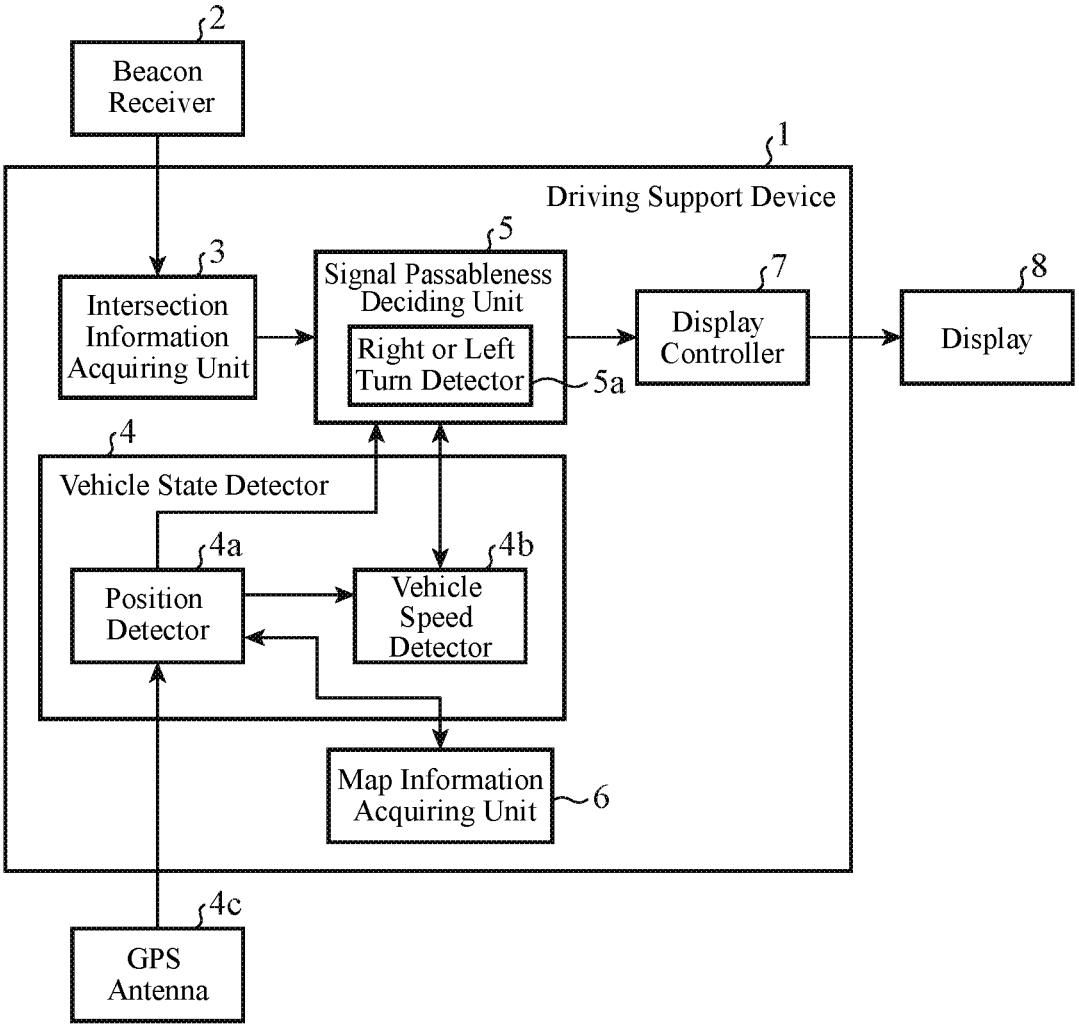
FIG. 1 is a block diagram showing a configuration of a driving support device of an embodiment 1 in accordance with the present invention.

FIG. 1 is a block diagram showing a configuration of a driving support device of an embodiment 1 in accordance with the present invention.

The driving support device 1 is realized as one of the functions of a car navigation system mounted on a vehicle, for example. Incidentally, the vehicle can be not only a car, but also a motorcycle or a bicycle.

As shown in FIG. 1, the driving support device 1, which is connected with a beacon receiver 2, a GPS (Global Positioning System) antenna 4*c* and a display 8, comprises as its functional components an intersection information acquiring unit 3, a vehicle state detector 4, a signal passableness deciding unit 5, a map information acquiring unit 6 and a display controller 7.

The beacon receiver 2 is mounted on the vehicle, receives the intersection information from an optical beacon road apparatus installed on the road along which the vehicle travels, and transfers the intersection information to the intersection information acquiring unit 3.

The intersection information acquiring unit 3 obtains from the intersection information received by the beacon receiver 2 the signal light information about the traffic signals installed at one or more intersections ahead of the vehicle, and distances from the vehicle to the intersections.

The vehicle state detector 4, which detects a vehicle state including the position and the speed of travel of the vehicle, comprises a position detector 4*a* and a vehicle speed detector 4*b*.

The position detector 4*a* detects the present position of the vehicle with the driving support device 1 from the latitude and longitude of the vehicle position obtained by analyzing the signals from GPS satellites received with the GPS antenna 4*c* and from the map information the map information acquiring unit 6 obtains. The vehicle speed detector 4*b* detects the speed of travel of the vehicle from changes of the present position of the vehicle with time, which the position detector 4*a* obtains.

Incidentally, the position detector 4*a* can be a component for acquiring only the position information of the vehicle measured by external equipment with a position measuring function, and the vehicle speed detector 4*b* can possess a function of directly detecting the speed of the vehicle by receiving the vehicle speed pulses.

The signal passableness deciding unit 5 decides the passable or impassable state of the traffic signals by the vehicle from the signal light information and distances to the intersections the intersection information acquiring unit 3 obtains and from the present position and the speed of travel of the vehicle the vehicle state detector 4 detects. In addition, the signal passableness deciding unit 5 comprises a right or left turn detector 5*a*. The right or left turn detector 5*a* has a function of detecting whether or not the vehicle turns an intersection or not from the present position of the vehicle and the intersection information. For example, it detects whether or not the vehicle turns any one of the intersections as to which the signal passableness deciding unit 5 makes a passable or impassable decision of the traffic signals.

The map information acquiring unit 6 obtains the map information including the present position of the vehicle the position detector 4*a* detects. For example, it obtains the map information from a hard disk drive, SD card, USB memory or the like the driving support device 1 comprises. Alternatively, it can download the map information from an external map data server.

The display controller 7 has a function of controlling the display processing of the display 8, and causes the display 8 to display a map including the present position of the vehicle.

In addition, the display controller 7 displays the passable or impassable state of the traffic signals decided by the signal passableness deciding unit 5 by changes of color on the map on the display 8.

The display 8, which undergoes display control by the display controller 7, displays a road map around the vehicle position on the screen as a navigation screen, for example.

Figure 2:
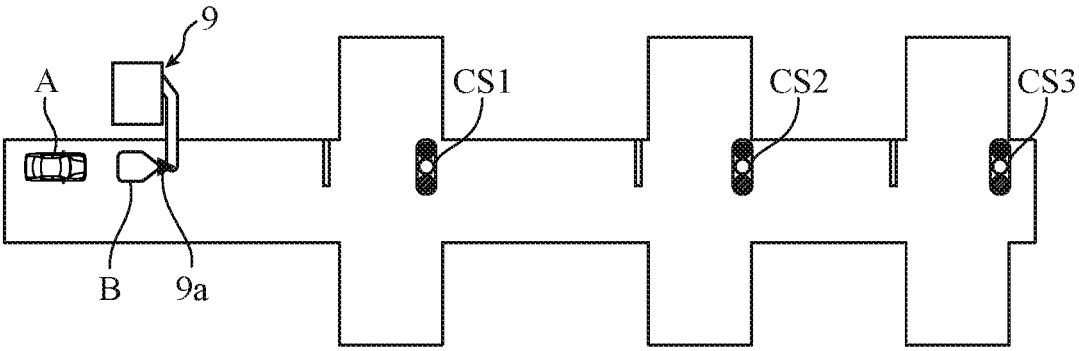
FIG. 2 is a diagram showing an example of intersections to which the present invention is applied.

FIG. 2 is a diagram showing an example of the intersections to which the present invention is applied. The vehicle A shown in FIG. 2 has the driving support device 1 mounted thereon. The optical beacon road apparatus 9 is road equipment that carries out communication by an optical beacon output from the optical beacon header 9*a*, and is installed on the road before each of the one or more intersections. When the vehicle A comes to a communication region B of the optical beacon header 9*a*, the beacon receiver 2 described above receives the intersection information that has been set in the optical beacon road apparatus 9. It is assumed in FIG. 2 that the intersection information about the three intersections ahead of the installation place of the optical beacon road apparatus is set in the optical beacon road apparatus 9.

In addition, the intersection information includes the signal light information about the traffic signals CS1-CS3 installed at the intersections ahead of the installation position of the optical beacon road apparatus 9, and the distances to the intersections from the installation position of the optical beacon road apparatus 9 (the position of the vehicle A at the time of the optical beacon communication).

The signal light information is information indicating the traffic light colors of the traffic signals CS1-CS3. For example, it includes the present traffic light color (green, yellow, and red) of each of the traffic signals, its remaining time, the traffic light color after the remaining time has elapsed, and the lighting time period over several cycles. Accordingly, the traffic light colors of the traffic signals CS1-CS3 and the remaining time at any give time can be obtained from the signal light information.

Next, the operation will be described.

Figure 3:
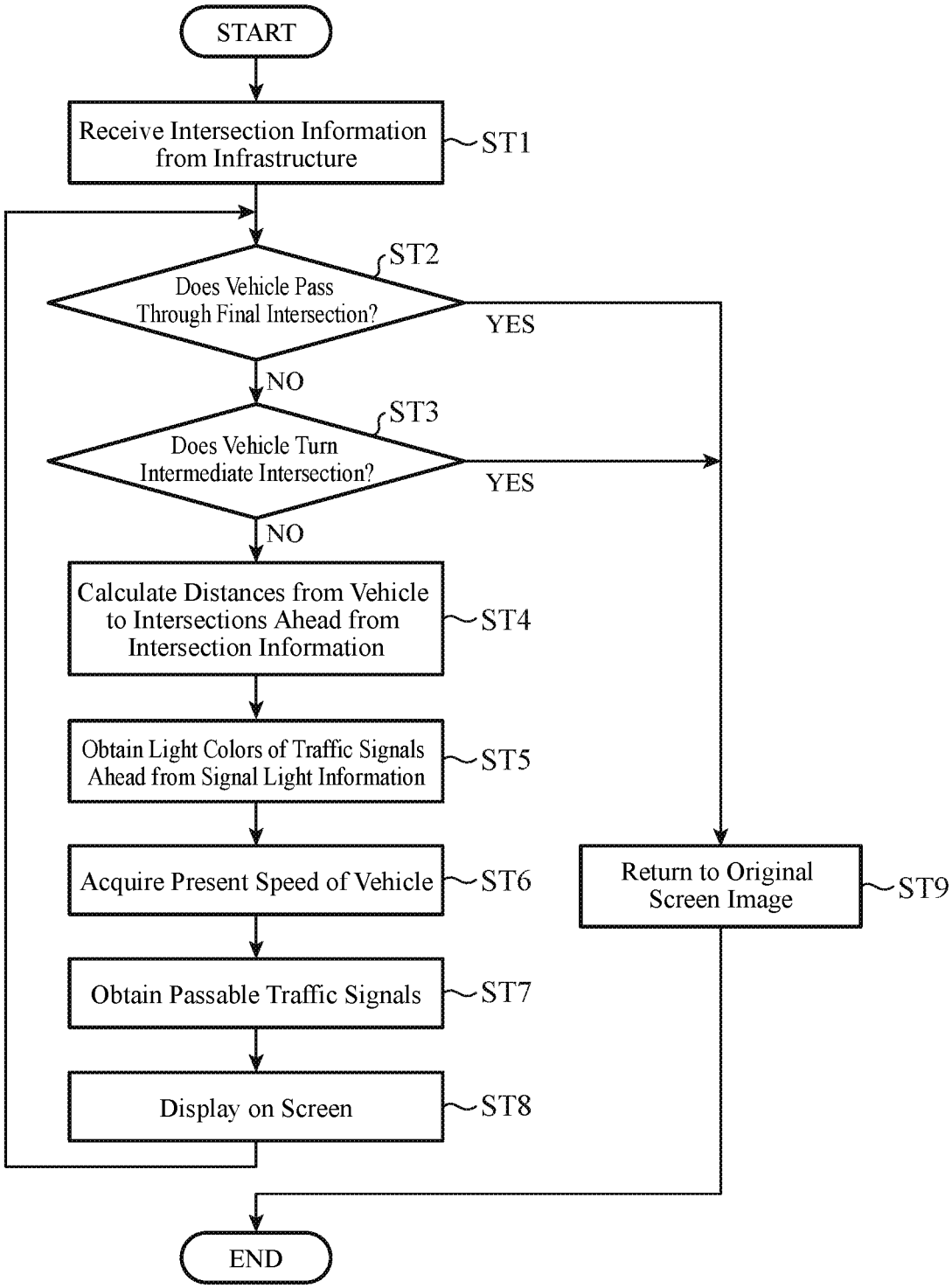
FIG. 3 is a flowchart showing the operation of the driving support device of the embodiment 1.

FIG. 3 is a flowchart showing the operation of the driving support device of the embodiment 1, which shows the processing of displaying the result of deciding the passable or impassable state of the traffic signals at the present speed of the vehicle.

First, the beacon receiver 2 receives the intersection information from the infrastructure equipment (optical beacon road apparatus 9) installed on the road (step ST1). The intersection information received by the beacon receiver 2 is transferred to the intersection information acquiring unit 3.

In addition, the intersection information acquiring unit 3 outputs the intersection information to the signal passableness deciding unit 5.

Using the intersection information received from the intersection information acquiring unit 3 and the present position of the vehicle information (vehicle position and its surrounding map) the position detector 4*a* detects, the signal passableness deciding unit 5 decides whether or not the vehicle has passed through the final intersection set in the intersection information (step ST2).

If the vehicle has not yet passed through the final intersection (NO at step ST2), the right or left turn detector 5*a* detects whether the vehicle turns an intermediate intersection or not from the intersection information output by the intersection information acquiring unit 3 and from the present position of the vehicle information (vehicle position and its surrounding map) the position detector 4*a* detects (step ST3).

If the vehicle does not turn any intermediate intersections (NO at step ST3), the signal passableness deciding unit 5 calculates the distances to the intersections ahead of the vehicle from the present position of the vehicle provided by the position detector 4*a* and from the distances to the intersections contained in the intersection information (step ST4).

For example, using the distances from the installation position of the optical beacon road apparatus 9 to the intersections and the present position of the vehicle, the signal passableness deciding unit 5 calculates the distances from the present position of the vehicle to the intersections ahead of the vehicle.

Next, the signal passableness deciding unit 5 obtains the light colors of the traffic signals installed at the intersections ahead of the vehicle from the signal light information contained in the intersection information (step ST5). For example, according to the signal light information, it obtains the light colors of the traffic signals CS1-CS3 shown in FIG. 2 and their remaining time.

Subsequently, the signal passableness deciding unit 5 acquires the present speed of the vehicle the vehicle speed detector 4*b* detects (step ST6).

After that, the signal passableness deciding unit 5 decides a passable traffic signal at the present speed of the vehicle from the distances to the intersections ahead of the vehicle, from the light colors and their remaining time of the traffic signals CS1-CS3 obtained from the signal light information, and from the present speed of the vehicle the vehicle speed detector 4*b* detects (step ST7). Here, as for the traffic signals as to which a decision is made of their passable or impassable state at the present vehicle speed, their information is delivered from the signal passableness deciding unit 5 to the display controller 7.

The display controller 7 displays the passable or impassable state of the traffic signals the signal passableness deciding unit 5 decides by the changes of color on the map on the display 8 (step ST8). After that, returning to step ST2, the foregoing processing is repeated at regular intervals.

In contrast, when the vehicle has passed through the final intersection (YES at step ST2) or turned the intermediate intersection (YES at step ST3), the display controller 7 returns the screen display on the display 8 to the original screen state from the screen on which the passable or impassable state of the traffic signals is displayed (step ST9). After that, the processing is terminated.

Figure 4:
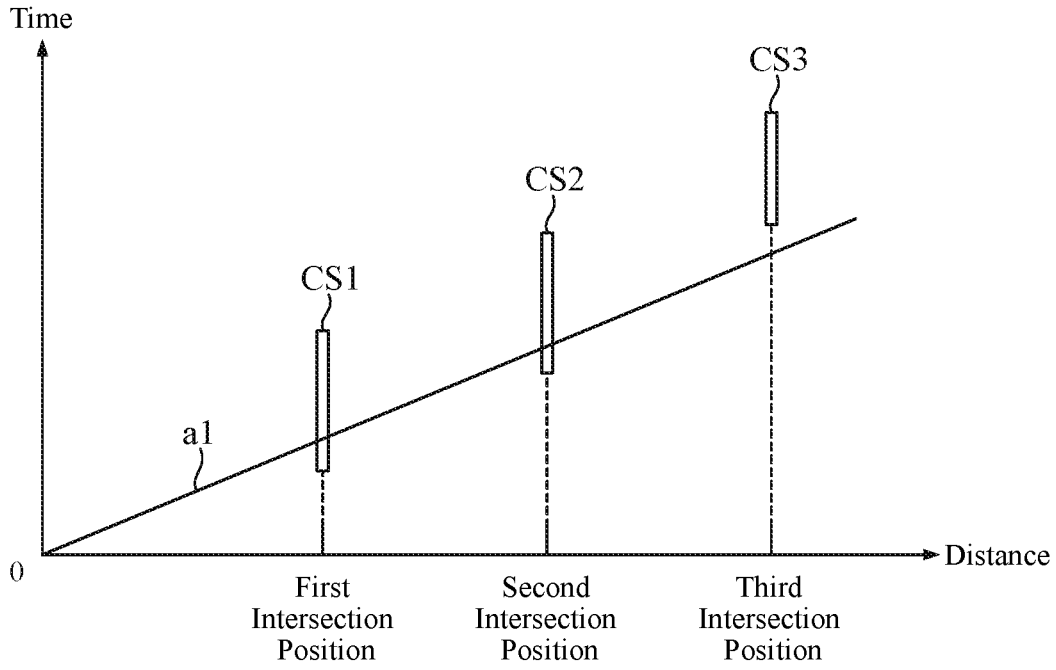
FIG. 4 is a diagram showing an outline of making a passable or impassable decision of traffic signals (when there is an impassable traffic signal)

FIG. 4 is a diagram showing an outline of deciding the passable or impassable state of the traffic signals (when there is an impassable traffic signal), which shows an example of executing the processing at step ST7 of FIG. 3 as to the intersections of FIG. 2. In FIG. 4, the horizontal axis shows the distances to the intersections from the vehicle A, and the vertical axis shows the time elapsed from the present time.

First, the signal passableness deciding unit 5 calculates the starting time and ending time of the green lights of the traffic signals CS1-CS3 from the signal light information about the traffic signals at the individual intersections, thereby obtaining a passable time period. Thus, as shown in FIG. 4, the individual passable time periods are obtained of the three traffic signals CS1-CS3 from the first intersection to the third intersection.

Next, according to the present vehicle speed acquired from the vehicle speed detector 4*b* and the distances to the intersections contained in the intersection information, the signal passableness deciding unit 5 calculates the time (passage time) at which the vehicle will pass through the individual intersections when maintaining the present vehicle speed. In FIG. 4, the slope of the line a1 denotes the present vehicle speed. If the line a1 crosses the passable time periods at the passage time, the signal passableness deciding unit 5 decides that the traffic signal at the intersection is passable if the vehicle maintains the present vehicle speed.

In the example of FIG. 4, it decides that although the first intersection and the second intersection are passable, the third intersection is impassable.

Figure 5:
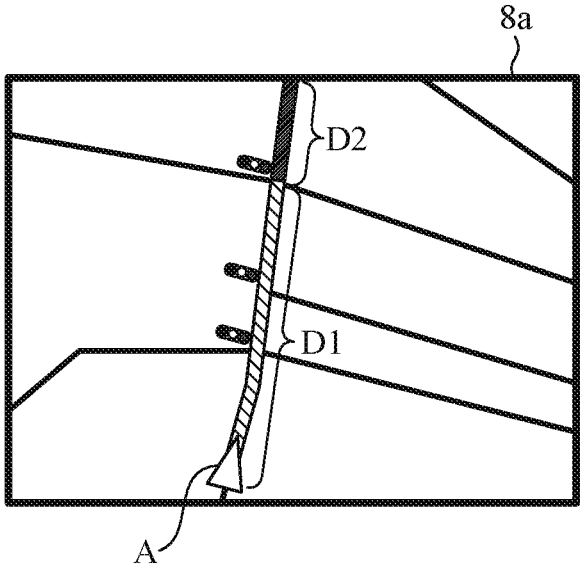
FIG. 5 is a diagram showing an example of a screen for providing information about a decision result of FIG. 4.

FIG. 5 is a diagram showing an example of a screen for giving information about the decision result of FIG. 4. The display controller 7 always displays on the display 8 the surrounding road map of the vehicle and the vehicle position.

The passable or impassable states of the traffic signals decided by the signal passableness deciding unit 5 as described above are displayed by changes of color on the map screen 8*a*.

For example, as shown in FIG. 5, the road D1 starting from the vehicle position (vehicle A) and passing through the intersections whose traffic signals are decided as passable is displayed in a first color, and the road D2 starting from the intersection whose traffic signal is decided as impassable by the vehicle is displayed in a second color different from the first color.

Here, the first color can be green which usually represents that the vehicle may proceed, and the second color can be red which usually represent that the vehicle cannot proceed. This enables the driver to recognize the passable intersections by the vehicle readily from the difference in color of the road.

Figure 6:
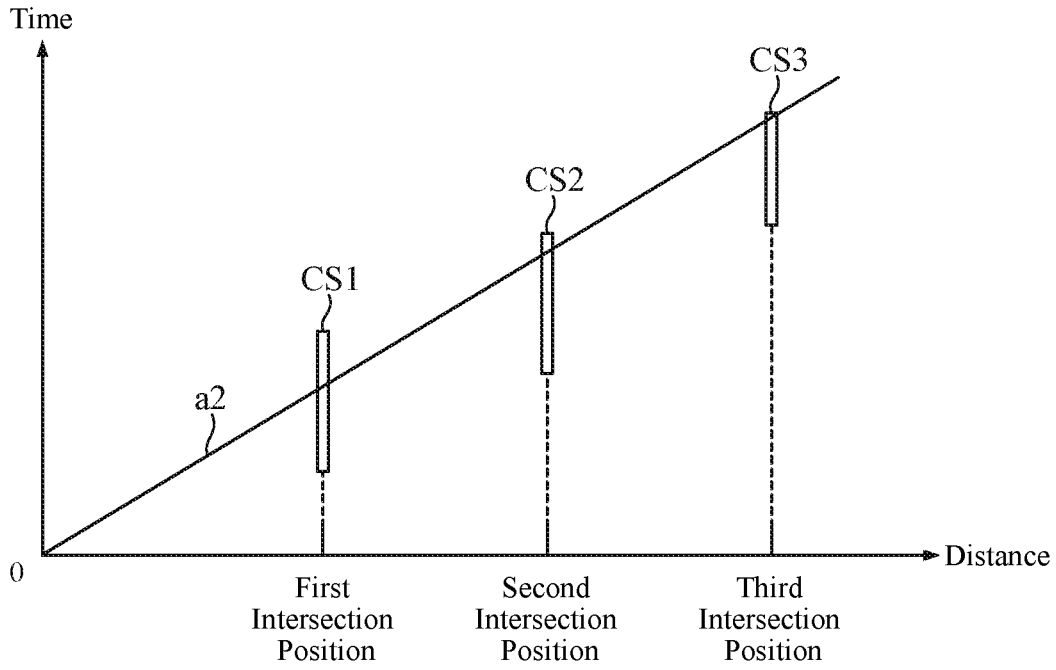
FIG. 6 is a diagram showing an outline of making a passable or impassable decision of traffic signals (when there is no impassable traffic signal)

FIG. 6 is a diagram showing an outline of deciding the passable or impassable state of the traffic signals (when there is no impassable traffic signal), which shows as FIG. 4 an example of executing the processing at step ST7 of FIG. 3 as to the intersections of FIG. 2. In the example of FIG. 6, the present vehicle speed is faster than that of FIG. 4, and the line a2 crosses the passable time periods of the individual traffic signals CS1-CS3 at the passage time of the individual intersections.

Thus, the signal passableness deciding unit 5 decides that the vehicle can pass through all the traffic signals at the first to the third intersections.

Figure 7:
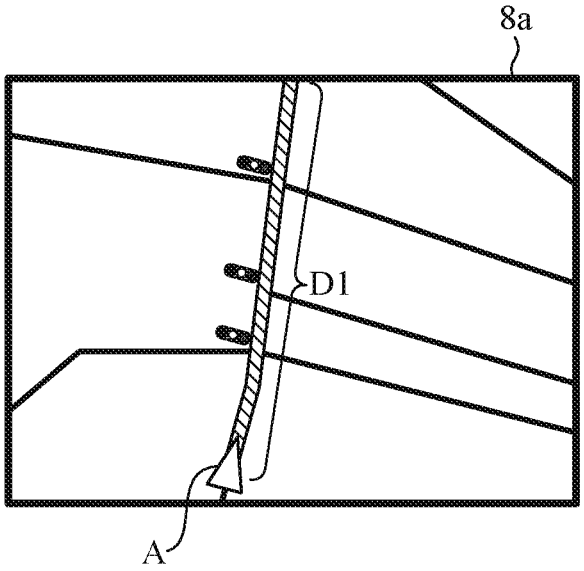
FIG. 7 is a diagram showing an example of a screen informing of a decision result of FIG. 6.

FIG. 7 is a diagram showing an example of a screen for giving information about the decision result of FIG. 6. Since the vehicle can pass through all the traffic signals at the first to third intersections, a road D1 which passes through the intersections whose traffic signals are decided as passable from the vehicle position (vehicle A) is displayed in a color different from a color of the other roads in FIG. 7. For example, the road D1 can be displayed in green which usually represents that the vehicle may proceed.

As for the intersections as to which the passable or impassable state of the traffic signals are decided, although they are displayed by variations of coloring, it is also possible to change coloring patterns. For example, although the road passing through the intersections whose traffic signals are decided as passable is displayed in green, the road from the intersection whose traffic signal is decided as impassable can be displayed by blinking a red color.

In addition to the changes of the color of the road, it is also possible to display it by changing a traffic signal icon or adding a new icon. For example, the road passing through the intersections whose traffic signals are decided as passable is displayed in green, and a balloon icon mentioning "passable so far" can be added to the final passable signal. Alternatively, the traffic signal icons decided as passable can be highlighted. As for a method of highlighting, it is conceivable to change the size (increasing the size) of an icon, or to change the color or coloring pattern of an icon.

Furthermore, the signal passableness deciding unit 5 can instruct a voice output controller to give information about the decision result of the passable or impassable states of the traffic signals. For example, a speech guide such as "the next two intersections are passable at the present speed" can be output from an in-vehicle speaker.

As described above, according to the present embodiment 1, it comprises: the intersection information acquiring unit 3 to obtain the signal light information about the traffic signals installed at one or more intersections ahead of a road along which the vehicle is traveling and to obtain distances to the intersections; the vehicle state detector 4 to detect the position and speed of travel of the vehicle; the signal passableness deciding unit 5 to decide a passable or impassable state of the traffic signals by the vehicle from the signal light information and the distances to the intersections the intersection information acquiring unit 3 obtains, and from the position and speed of travel of the vehicle the vehicle state detector 4 detects; and the display controller 7 to display a map including the position of the vehicle on a display 8, and to display the passable or impassable state of the traffic signals decided by the signal passableness deciding unit 5 by changes of color on the map. With such a configuration, it can enable a driver to readily recognize the intersections whose traffic signals are passable by the vehicle by the changes of color on the map. This makes it possible to reduce the stopping number of times of the vehicle and to effectively carry out eco-friendly driving with reduced fuel consumption.

In addition, according to the present embodiment 1, the display controller 7 displays a road passing through the intersections, whose traffic signals are decided as passable from the vehicle position by the signal passableness deciding unit 5, in a first color, and displays a road passing through the intersection whose traffic signal is decided as impassable in a second color different from the first color. Thus, it can enable a driver to readily recognize the intersections whose traffic signals are passable by the vehicle by the changes of color of the road.

Furthermore, according to the present embodiment 1, it further comprises a right or left turn detector 5*a* to detect whether the vehicle turns an intersection or not, wherein the display controller 7 terminates the display of the passable or impassable state of the traffic signal when the right or left turn detector 5*a* detects that the vehicle has turned the intersection.

Thus, when detecting that the vehicle has turned the intermediate intersection, it terminates the display. Accordingly, it can prevent continuing the driving support on the road so far after the right or left turn.

Embodiment 2

Figure 8:
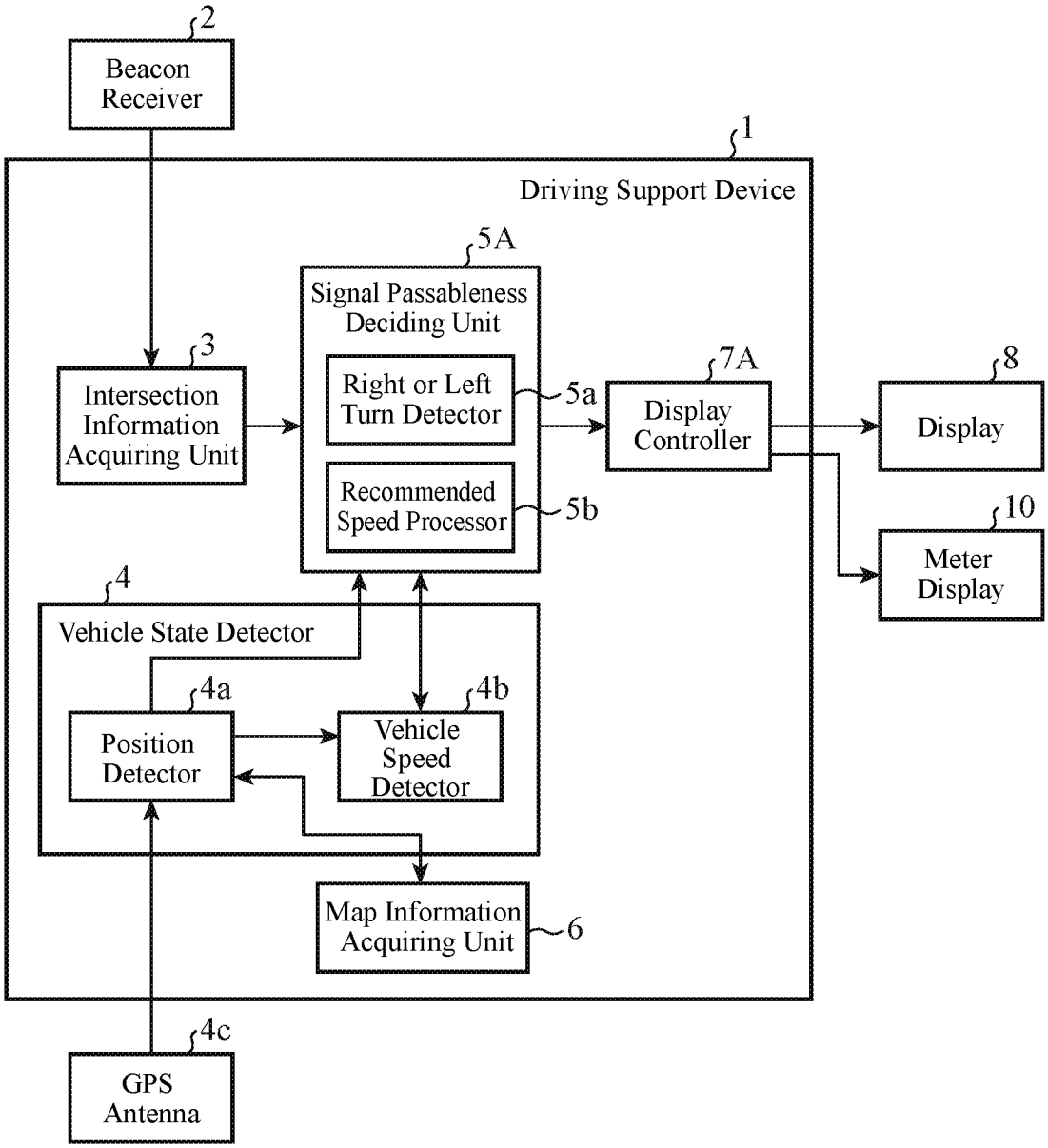
FIG. 8 is a block diagram showing a configuration of a driving support device of an embodiment 2 in accordance with the present invention.

FIG. 8 is a block diagram showing a configuration of a driving support device of an embodiment 2 in accordance with the present invention.

Although the driving support device 1A of the embodiment 2 has basically the same configuration as the embodiment 1, it differs in that it comprises a signal passableness deciding unit 5A including a recommended speed processor 5*b*, and a display controller 7A to display a decision result by the signal passableness deciding unit 5A on the display 8 or on a meter display 10.

The recommended speed processor 5*b* is a processor to calculate a recommended speed, at which the vehicle can pass through the traffic signals, from the signal light information, the distances to the intersections, the position of the vehicle and the speed of travel of the vehicle.

The display controller 7A displays the road passing through the intersections whose traffic signals are passable when the vehicle travels at the recommended speed by changes of color on a map displayed on the display 8. In addition, the display controller 7A displays the recommended speed the recommended speed processor 5*b* calculates on a speedometer image on the meter display 10 together with the present speed. The meter display 10 is a display mounted on the instrument panel (dashboard) of the vehicle to display an image of the meter and the like.

Incidentally, the display controller 7A can display the recommended speed on the screen of the display 8. In this case, it is conceivable to display the recommended speed on a map the display 8 displays or on a part other than the map.

Next, the operation will be described.

Figure 9:
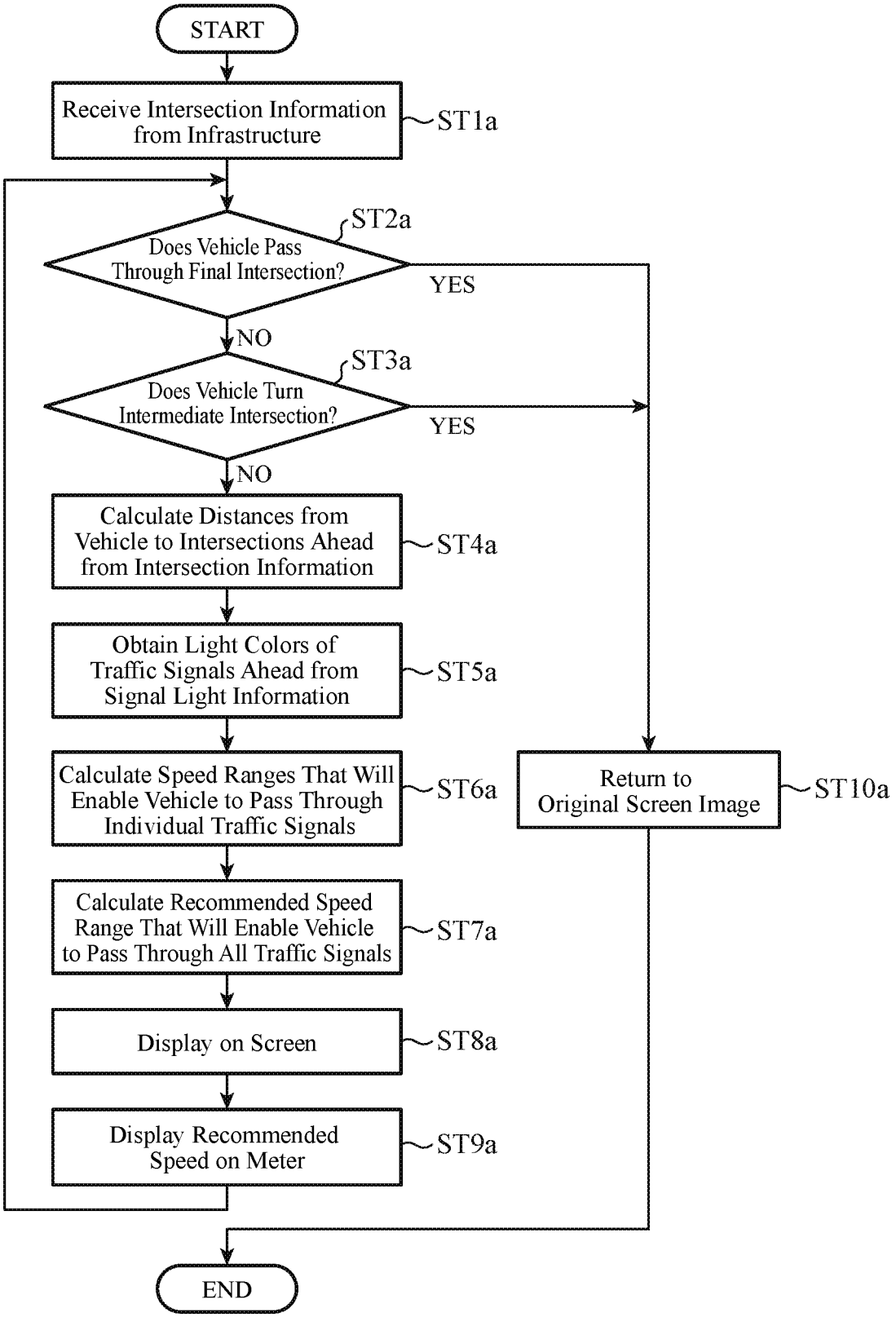
FIG. 9 is a flowchart showing the operation of the driving support device of the embodiment 2.

FIG. 9 is a flowchart showing the operation of the driving support device of the embodiment 2, which shows the processing of displaying the road and intersections whose traffic signals are passable by the vehicle traveling at the recommended speed. Incidentally, since the processing from step ST1*a* to step ST5*a* in FIG. 9 is the same as the processing from step ST1 to step ST5 in FIG. 3, and the processing at step ST8*a* is the same as the processing at step ST8, their description will be omitted.

At step ST6*a*, the recommended speed processor 5*b* calculates the speed ranges, within which the vehicle can pass through the traffic signals of the individual intersections during a green light when the vehicle travels from the present position of the vehicle to the positions of the individual intersections, respectively, from the signal light information about the individual traffic signals installed at the intersections and the present position information of the vehicle the position detector 4*a* detects. Next, the recommended speed processor 5*b* calculates a speed range that will enable the vehicle to pass through the traffic signals of all the intersections from the speed ranges of the individual intersections as the recommended speed range (step ST7*a*).

When the vehicle travels at the recommended speed the recommended speed processor 5*b* calculates, the display controller 7A displays the passable traffic signals and the road on which the traffic signals are installed by changes of color on the map on the display 8 (step ST8*a*).

Next, the display controller 7A displays the recommended speed together with the present speed on the speedometer image on the meter display 10 (step ST9*a*). After that, it returns to step ST2*a* to iterate the foregoing processing at regular intervals.

Figure 10:
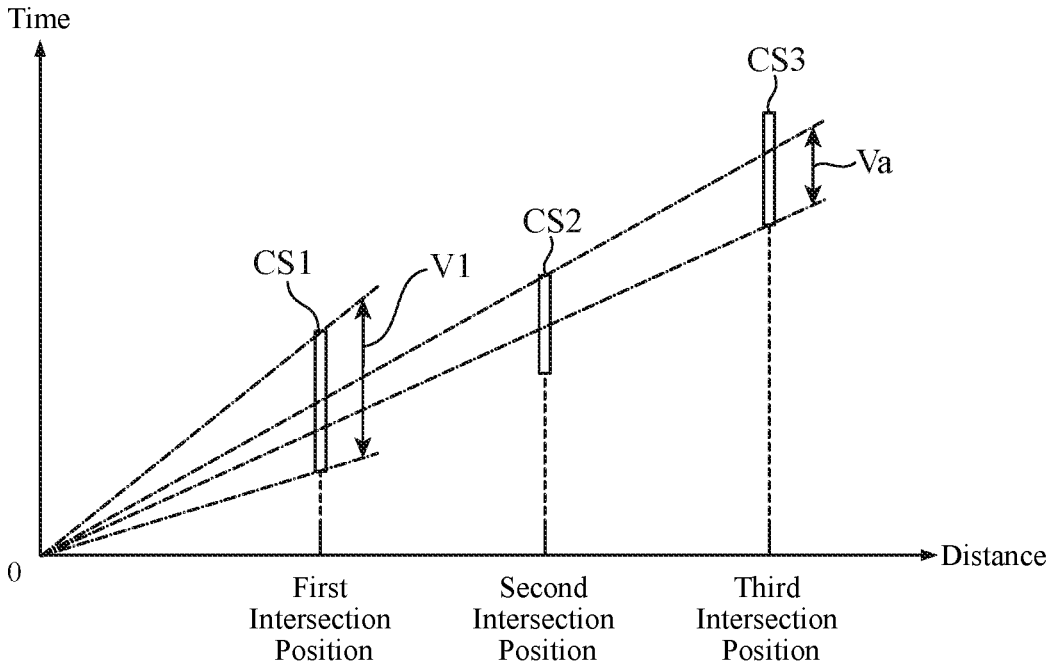
FIG. 10 is a diagram showing an outline of calculation processing of a recommended speed at which traffic signals are passable.

FIG. 10 is a diagram showing an outline of the calculation processing of the recommended speed at which the vehicle can pass through the traffic signals, which shows a case where the processing of step ST6*a* and step ST7*a* of FIG. 9 is performed as to the intersections of FIG. 2. In FIG. 10, the horizontal axis shows the distances from the vehicle A to the intersections, and the vertical axis shows the time elapsed from the present time.

First, the signal passableness deciding unit 5A obtains a passable time period by calculating the starting time and ending time of the green lights of the traffic signals CS1-CS3 from the signal light information about the traffic signals at the individual intersections in the same manner as in FIG. 4. Thus, as shown in FIG. 10, the individual passable time periods of the three traffic signals CS1-CS3 from the first intersection to the third intersection are obtained.

The recommended speed processor 5*b* calculates the speed range, within which the vehicle can pass through the individual traffic signals CS1-CS3 during the green lights, from the individual passable time periods of the traffic signals CS1-CS3 the signal passableness deciding unit 5A calculates. Here, the passable speeds through the individual traffic signals CS1-CS3 are included in the speed ranges between the speed at which the vehicle arrives at the intersections at the ending time of the green lights and the speed at which the vehicle arrives at the intersections at the starting time of the green lights when traveling from the present position of the vehicle.

For example, in FIG. 10, the speed range V1 including the speed enabling the vehicle to pass through the traffic signal CS1 is the speed range between the speed at which the vehicle arrives at the first intersection position at the ending time of the green light of the traffic signal CS1 and the speed at which the vehicle arrives as the first intersection position at the starting time of the green light. The recommended speed processor 5*b* calculates the speed range for each of the intersections.

Next, the recommended speed processor 5*b* obtains the speed range that will enable the vehicle to pass through all the traffic signals CS1-CS3 of the intersections by successively obtaining the speed range common to the speed ranges of the individual intersections beginning from the closest intersection.

In FIG. 10, the speed range Va common to all the speed ranges from the first intersection to the third intersection is obtained as the speed range in which the vehicle will be able to pass through all the traffic signals CS1-CS3 of the intersections. The speed range Va is made the recommended speed range.

Figure 11:
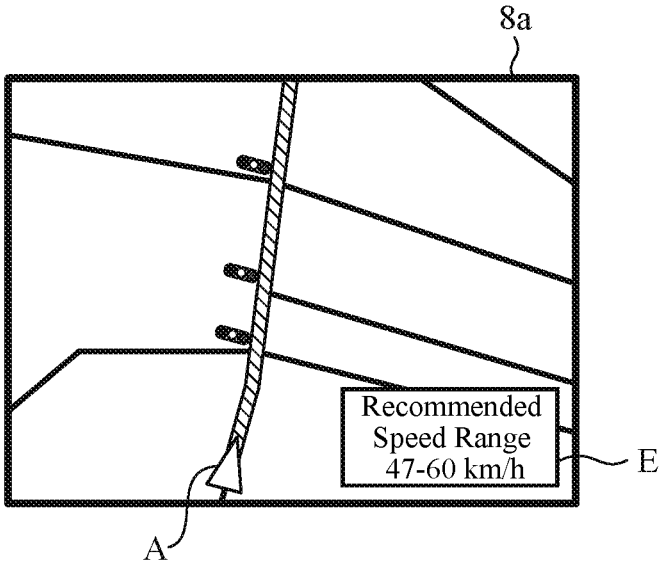
FIG. 11 is a diagram showing an example of a screen displaying recommended speed information and a road passable at the speed.

FIG. 11 is a diagram showing an example of a screen for giving information about the recommended speed and displays the road passable at the speed, which shows the calculation result of the recommended speed of FIG. 10. Since the vehicle will be able to pass through all the traffic signals at the first to third intersections by traveling at the recommended speed, the road from the vehicle position (vehicle A) is display in a different color. For example, the road can be displayed in green which usually represents that the vehicle may proceed as in the foregoing embodiment 1.

This makes it possible for the driver to easily confirm the recommended speed visually, and to readily recognize the passable intersections by the vehicle at the recommended speed from the road color.

In addition, in FIG. 11, although the display controller 7A displays the recommended speed range E on the map on the display 8, the recommended speed can be displayed in a speed display window which is prepared outside the map on the screen 8*a*.

Figure 12:
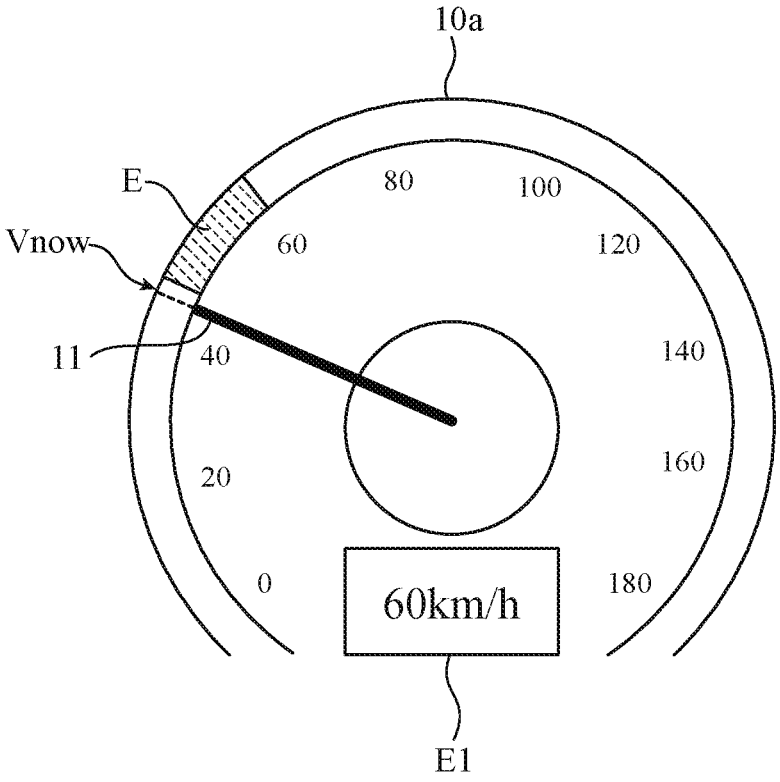
FIG. 12 is a diagram showing a display example of an speedometer image informing a user of the recommended speed.

FIG. 12 is a diagram showing an example of the display of a speedometer image for giving information of the recommended speed. As shown in FIG. 12, the display controller 7A displays a speedometer image 10*a* on the meter display 10.

The speedometer image 10*a* shows, for example, the present speed Vnow of the vehicle as a reading of the indicator 11, the recommended speed range E within the scale, and the upper limit E1 of the recommended speed range E in a digital speed display. Thus, the driver can readily recognize the recommended speed from the display contents of the speedometer.

In addition, a configuration is also possible in which the signal passableness deciding unit 5A instructs a speech output controller to give information about the intersections passable at the recommended speed by speech.

For example, a speech guide such as "the next two intersections are passable at the present speed" can be output from an in-vehicle speaker.

As described above, according to the present embodiment 2, it further comprises the recommended speed processor 5*b* to calculate the recommended speed, at which the vehicle is able to pass through the traffic signals, from the signal light information, the distances to the intersections and the position of the vehicle, wherein the display controller 7A displays the road passing through the intersections whose traffic signals are passable by the changes of color on the map, when the vehicle travels at the recommended speed.

With such a configuration, the driver can readily recognize the passable intersections at the recommended speed by the changes of color on the map. This makes it possible to reduce the stopping number of times of the vehicle and to effectively carry out eco-friendly driving with reduced fuel consumption.

In addition, according to the present embodiment 2, the display controller 7A displays the recommended speed on the speedometer image. This enables the driver to readily recognize the recommended speed from the display contents of the speedometer.

Furthermore, according to the present embodiment 2, the display controller 7A displays the recommended speed on the screen 8*a* of the display 8. This enables the driver to readily recognize the recommended speed from the display contents on the screen 8*a*.

Embodiment 3

Figure 13:
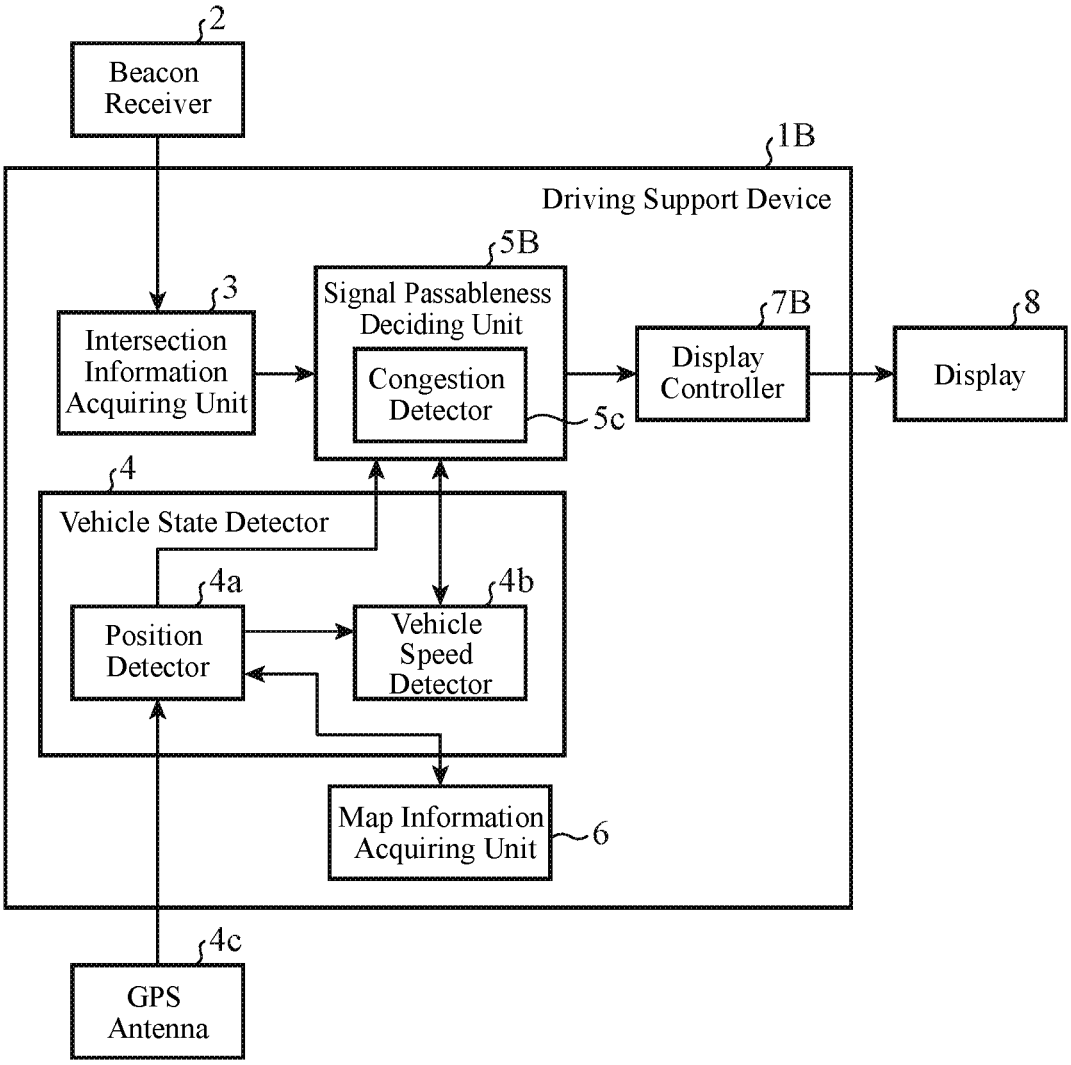
FIG. 13 is a block diagram showing a configuration of a driving support device of an embodiment 3 in accordance with the present invention.

FIG. 13 is a block diagram showing a configuration of a driving support device of an embodiment 3 in accordance with the present invention. In FIG. 13, although the driving support device 1B of the embodiment 3 has basically the same configuration as the embodiment 1, it differs in that it comprises a signal passableness deciding unit 5B including a congestion detector 5*c*, and a display controller 7B.

The congestion detector 5*c* is a detector to detect congestion occurring ahead of the road on which the vehicle is traveling.

For example, it decides whether the congestion occurs ahead of the road on which the vehicle is traveling according to whether a target road of the congestion information the intersection information acquiring unit 3 obtains from a VICS (registered trademark, the mention of which will be omitted from now on) information center agrees with the road including the intersections in the intersection information.

Alternatively, a configuration is also possible which detects congestion with a sensor such as a camera or radar, or which acquires congestion information from external equipment such as a smartphone.

The decision as to whether the congestion is detected or not is made as the processing in place of step ST3 shown in FIG. 3 or in a step following step ST3, for example.

In addition, the display controller 7B controls the display processing of the display 8 as in the embodiment 1, and if the congestion detector 5*c* detects the congestion, it terminates the display of the passable or impassable state of the traffic signal.

As described above, according to the present embodiment 3, it comprises a congestion detector 5*c* to detect congestion ahead of the road along which the vehicle is traveling, wherein the display controller 7B terminates the display of the passable or impassable state of the traffic signals when the congestion detector 5*c* detects the congestion. Thus, it does not display the passable or impassable state of the traffic signal if the road along which the vehicle is traveling has congestion ahead, and if the eco-friendly driving support with the reduced stopping number of times cannot be expected. Thus, it can prevent inappropriate driving support from being performed.

Embodiment 4

Figure 14:
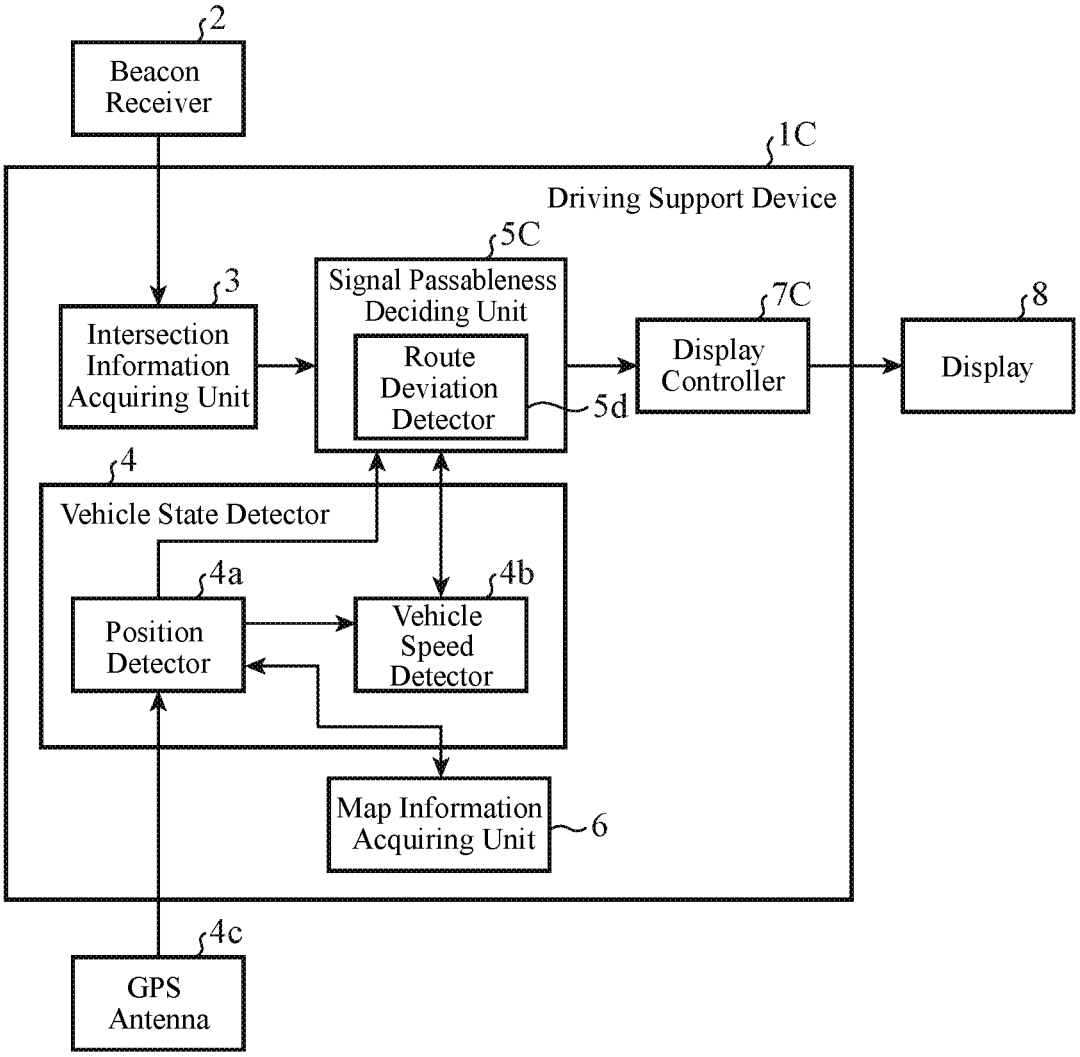
FIG. 14 is a block diagram showing a configuration of a driving support device of an embodiment 4 in accordance with the present invention.

FIG. 14 is a block diagram showing a configuration of a driving support device of an embodiment 4 in accordance with the present invention. In FIG. 14, although the driving support device 1C of the embodiment 4 has basically the same configuration as the embodiment 1, it differs in that it comprises a signal passableness deciding unit 5C including a route deviation detector 5*d*, and a display controller 7C.

The route deviation detector 5*d* is a detector for detecting that the vehicle deviates from a guide route up to the destination. For example, it decides whether the vehicle deviates from the guide route or not from the position information of the vehicle the position detector 4*a* detects and the guide route information that prescribes the route up to the destination in accordance with the map information.

In addition, the display controller 7C controls the display processing of the display 8 as in the embodiment 1, and displays the passable or impassable state of the traffic signals on the guide route by changing colors on the map on the display 8. Thus, the driver can readily recognize the passable intersections by the vehicle at the recommended speed from the colors of the guide route.

The decision as to whether the vehicle deviates from the guide route or not is made as the processing in place of step ST3 shown in FIG. 3 or in a step following step ST3, for example.

In addition, the display controller 7C terminates the display of the passable or impassable state of the traffic signal if the route deviation detector 5*d* detects the deviation from the guide route.

As described above, according to the present embodiment 4, the display controller 7C displays the passable or impassable state of the traffic signals installed on the guide route to the destination by the changes of color on the map. This enables the driver to readily recognize passable intersections by the vehicle at the recommended speed from the color of the guide route.

In addition, according to the present embodiment 4, it further comprises the route deviation detector 5*d* to detect that the vehicle deviates from the guide route, wherein the display controller 7C terminates the display of the passable or impassable state of the traffic signals when the route deviation detector 5*d* detects that the vehicle deviates from the guide route.

Thus, if the vehicle deviates from the guide route and does not travel on the road as to which the passable or impassable states of the traffic signals are displayed, the display controller 7C terminates the display of the passable or impassable state of the traffic signals. Thus, it can prevent inappropriate driving support from being performed.

Incidentally, although the foregoing descriptions are made by way of example of terminating the display of the passable or impassable state of the traffic signals in accordance with the detection result of any one of the right or left turn detector 5*a*, congestion detector 5*c* and route deviation detector 5*d*, a free combination of the detectors 5*a*, 5*c* and 5*d* is possible.

In addition, although the embodiments 1 to 4 are described on the assumption that the driving support device is realized as one of the functions of the car navigation system, another type of apparatus is also possible.

For example, a configuration is also possible in which an in-vehicle display audio set comprises the display 8, and a portable terminal such as a smartphone or an external server comprises the intersection information acquiring unit 3, vehicle state detector 4, signal passableness deciding unit 5, map information acquiring unit 6 and display controller 7, and the display audio set displays the passable or impassable state of the traffic signal by changes of color by carrying out communication with the portable terminal or with the external server.

Furthermore, although the foregoing embodiments are described by way of example that uses the optical beacon for the communication with the infrastructure equipment, a configuration is also possible which employs communication via an infrastructure communication system such as a wireless LAN, WAVE inter-vehicle communication, Bluetooth (registered trademark), 700 MHz band inter-vehicle communications, 5 GHz band inter-vehicle communication, 5.8 GHz DSRC (Dedicated Short Range Communications), or communications using a mobile phone via a mobile phone base station.

Incidentally, it is to be understood that a free combination of the individual embodiments, variations of any components of the individual embodiments or removal of any components of the individual embodiments is possible within the scope of the present invention.

INDUSTRIAL APPLICABILITY

A driving support device in accordance with the present invention is able to recognize an intersection whose traffic signal is passable by the vehicle. Accordingly, it is suitable for an onboard driving support device to assist eco-friendly driving.

DESCRIPTION OF REFERENCE NUMERALS AND SIGNS

1, 1A-1C driving support device; 2 beacon receiver; 3 intersection information acquiring unit; 4 vehicle state detector; 4*a* position detector; 4*b* vehicle speed detector; 4*c* GPS antenna; 5, 5A-5C signal passableness deciding unit; 5*a* right or left turn detector; 5*b* recommended speed processor; 5*c* congestion detector; 5*d* route deviation detector; 6 map information acquiring unit; 7, 7A-7C display controller; 8 display; 8*a* screen; 9 optical beacon road apparatus; 9*a* optical beacon header; 10 meter display; 10*a* speedometer image; 11 indicator.

The invention claimed is:

1. A driving support device for assisting a driver to drive a vehicle, the driving support device comprising:

an intersection information acquirer to obtain signal light information about a plurality of traffic signals that are respectively installed at a plurality of intersections ahead of the vehicle on a road along which the vehicle is traveling and to obtain distances to the intersections, the road on which the vehicle is traveling being on a guide route up to a destination;

a vehicle state detector to detect a position and speed of travel of the vehicle;

a signal passableness decider to decide a passable or impassable state of each of the plurality of traffic signals on a basis of the obtained signal light information, the obtained distances to the plurality of intersections, and the detected position and speed of travel of the vehicle, by using a distance-time graph in which the distances of the plurality of intersections are indicated on a distance axis of the distance-time graph, a passable time period of each of the plurality of traffic signals at the plurality of intersections is indicated on a time axis of the distance-time graph, and the speed of the vehicle is indicated as a slope of a linear function, to show whether the slope crosses the passable time period of each of the plurality of traffic signals;

a display controller to display, on a display, a map including the passable or impassable state of the traffic signals decided by the signal passableness decider, the passable or impassable state of the traffic signals being indicated by changes of color on the display; and a route deviation detector that detects that the vehicle deviates from the guide route along which the vehicle is traveling, wherein the display controller is configured to terminate the display of the passable or impassable state of the traffic signals, on a basis of the route deviation detector detecting that the vehicle deviates from the guide route along which the vehicle is traveling.

2. The driving support device according to claim 1, wherein the route deviation detector is configured to detect a turn at an intersection by the vehicle.

3. The driving support device according to claim 1, wherein the plurality of traffic signals comprises a first traffic signal and a second traffic signal that are located at a first intersection and a second intersection of the plurality of intersections, respectively, and the first intersection is located closer to the vehicle than the second intersection, and when the first traffic signal is in the passable state and the second traffic signal is in the impassable state, the display controller displays, on the map, a first section of the road from the position of the vehicle to a position of the first intersection, in a first color, and displays a second section of the road from the position of the first intersection to an end of the road opposite to the position of the vehicle, in a second color different from the first color.

4. A driving support method for assisting a driver to drive a vehicle, the driving support method comprising the steps of:

obtaining, by an intersection information acquirer, signal light information about a plurality of traffic signals that are respectively installed at a plurality of intersections ahead of a vehicle on a road along which the vehicle is traveling and to obtain distances to the intersections, the road on which the vehicle is traveling being on a guide route up to a destination;

detecting, by a vehicle state detector, a position and speed of travel of the vehicle;

deciding, by a signal passableness decider, a passable or impassable state of each of the plurality of traffic signals on a basis of the obtained signal light information, the obtained distances to the plurality of intersections, and the detected position and speed of travel of the vehicle, by using a distance-time graph in which the distances of the plurality of intersections are indicated on a distance axis of the distance-time graph, a passable time period of each of the plurality of traffic signals at the plurality of intersections is indicated on a time axis of the distance-time graph, and the speed of the vehicle is indicated as a slope of a linear function, to show whether the slope crosses the passable time period of each of the plurality of traffic signals;

displaying, by a display controller, on a display a map including the passable or impassable state of the traffic signals being indicated by changes of color on the display;

detecting, by a route deviation detector, that the vehicle deviates from the guide route along which the vehicle is traveling; and terminating, by the display controller, the display of the passable or impassable state of the traffic signals, on a basis of the route deviation detector detecting that the vehicle deviates from the guide route along which the vehicle is traveling.

5. The driving support method according to claim 4, wherein the method further comprises a step of detecting, by a turn detector, a turn at an intersection by the vehicle.

6. The driving support method according to claim 4, wherein the plurality of traffic signals comprises a first traffic signal and a second traffic signal that are located at a first intersection and a second intersection of the plurality of intersections, respectively, and the first intersection is located closer to the vehicle than the second intersection, and when the first traffic signal is in the passable state and the second traffic signal is in the impassable state, the display controller displays, on the map, a first section of the road from the position of the vehicle to a position of the first intersection, in a first color, and displays a second section of the road from the position of the first intersection to an end of the road opposite to the position of the vehicle, in a second color different from the first color.

7. The driving support device according to claim 1, wherein the signal passableness decider decides the passable or impassable state of the plurality of traffic signals based on determining whether the slope crosses the passable time period of the plurality of traffic signals.

8. A driving support device for assisting a driver to drive a vehicle, the driving support device comprising:

an intersection information acquirer to obtain signal light information about traffic signals installed at one or more intersections ahead of the vehicle on a road along which the vehicle is traveling and to obtain distances to the intersections, the road on which the vehicle is traveling being on a guide route up to a destination;

a vehicle state detector to detect a position and speed of travel of the vehicle;

a signal passableness decider to decide a passable or impassable state of the traffic signals on a basis of the obtained signal light information, the obtained distances to the intersections, and the detected position and speed of travel of the vehicle;

a display controller to display, on a display, a map including the passable or impassable state of the traffic signals decided by the signal passableness decider, the passable or impassable state of the traffic signals being indicated by changes of color on the display, wherein on the map, a road passing through the intersection whose traffic signal is decided as passable from the vehicle position by the signal passableness decider is shown in a first color, and a road passing through the intersection whose traffic signal is decided as impassable from the vehicle position is shown in a second color different from the first color; and a route deviation detector that detects that the vehicle deviates from the guide route along which the vehicle is traveling, wherein the display controller is configured to terminate the display of the passable or impassable state of the traffic signals, on a basis of the route deviation detector detecting that the vehicle deviates from the guide route along which the vehicle is traveling, thereby returning the map to the original state in which the map does not include the passable or impassable state of the traffic signals decided by the signal passableness decider, when the route deviation detector detects that the vehicle deviates from the guide route.

9. The driving support device according to claim 8, wherein the route deviation detector is configured to detect a turn at an intersection by the vehicle.

10. The driving support device according to claim 8, wherein the displayed map further includes the position of the vehicle.

* * * * *